US012630977B2

(12) United States Patent
Sakurada et al.

(10) Patent No.: US 12,630,977 B2
(45) Date of Patent: May 19, 2026

(54) SHEET MANUFACTURING APPARATUS

(71) Applicant: SEIKO EPSON CORPORATION, Tokyo (JP)

(72) Inventors: Koki Sakurada, Shiojiri (JP); Keishi Sawada, Shiojiri (JP); Kensaku Matsuda, Matsumoto (JP); Hayato Yanagawa, Shiojiri (JP); Kentaro Yamada, Matsumoto (JP); Toshizo Nishi, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 123 days.

(21) Appl. No.: 18/887,152

(22) Filed: Sep. 17, 2024

(65) Prior Publication Data

US 2025/0092603 A1 Mar. 20, 2025

(30) Foreign Application Priority Data

Sep. 19, 2023 (JP) ..... 2023-150802

(51) Int. Cl.

| | |
|---|---|
| ***D21F 1/80*** | (2006.01) |
| ***D21F 1/08*** | (2006.01) |
| ***D21F 3/08*** | (2006.01) |
| ***D21F 9/02*** | (2006.01) |

(52) U.S. Cl.

CPC ..... *D21F 1/80* (2013.01); *D21F 1/08* (2013.01); *D21F 3/08* (2013.01); *D21F 9/02* (2013.01)

(58) Field of Classification Search

CPC ..... D21F 1/80; D21F 1/08; D21F 3/08; D21F 9/02; D21F 9/00; D21F 7/00; B27N 3/08; B27N 1/00; B27N 1/02; B27N 3/007; B27N 3/04; B27N 3/18; D04H 1/732; B30B 11/18; B30B 15/302; D21B 1/10; D21B 1/32; D21H 11/14

See application file for complete search history.

(56) References Cited

U.S. PATENT DOCUMENTS

| | | | | |
|---|---|---|---|---|
| 11,008,705 | B2 * | 5/2021 | Higuchi | D21C 5/02 |
| 2019/0145023 | A1 | 5/2019 | Higuchi | |
| 2021/0230802 | A1 * | 7/2021 | Yamagami | D21F 9/00 |
| 2022/0034029 | A1 * | 2/2022 | Motohashi | D21F 9/00 |
| 2025/0092603 | A1 * | 3/2025 | Sakurada | D21F 9/00 |

FOREIGN PATENT DOCUMENTS

| | | | | |
|---|---|---|---|---|
| EP | 4527580 | A1 * | 3/2025 | B30B 15/302 |
| JP | 2019-085264 | A | 6/2019 | |
| JP | 2025043494 | A * | 4/2025 | B30B 15/302 |
| JP | 2025086479 | A * | 6/2025 | D21H 11/14 |

* cited by examiner

*Primary Examiner* — Jose A Fortuna
(74) *Attorney, Agent, or Firm* — Spencer Fane LLP

(57) ABSTRACT

A sheet manufacturing apparatus includes a buffer tank 13 that stores a material containing fibers; a defibrator 30 that defibrates the material supplied from the buffer tank 13 and discharges the fibers; a mixing unit 91 that mixes the fibers and a binding material binding the fibers to each other and discharges a mixture; a first transport belt 61*a* that transports the mixture; an accumulation unit 50 that accumulates the mixture on the first transport belt 61*a* to form a web W; a second transport belt 62*a* that comes into contact with one surface of the web W to transport the web W; processing rollers 71 and 72 that pressurize the web W; a cleaning unit 201 that removes and recovers residual fibers adhering to the first transport belt 61*a*; and a fiber transport pipe 22 that transports the residual fibers recovered by the cleaning unit 201 to the defibrator 30.

5 Claims, 4 Drawing Sheets

SHEET MANUFACTURING APPARATUS

The present application is based on, and claims priority from JP Application Serial Number 2023-150802, filed Sep. 19, 2023, the disclosure of which is hereby incorporated by reference herein in its entirety.

BACKGROUND

1. Technical Field

The present disclosure relates to a sheet manufacturing apparatus.

2. Related Art

JP-A-2019-85264 discloses a technique in which a mesh belt for transporting a web is disposed, and after the web is transported, fibers adhering to the mesh belt are removed by bringing the web into contact with a brush roller. The removed fibers, namely, waste fiber material is discarded.

However, in a configuration described in JP-A-2019-85264, when the amount of fibers to be recovered, namely, waste fiber material is large, maintenance by a user becomes complicated or raw material is wasted, which is a problem.

SUMMARY

A sheet manufacturing apparatus according to an aspect of the present disclosure is a sheet manufacturing apparatus that manufactures a sheet from a material containing fibers The apparatus includes: a storage tank that stores the material containing the fibers; a defibrator that defibrates the material supplied from the storage tank and discharges the fibers; a mixing unit that mixes the fibers and a binder binding the fibers to each other and discharges a mixture; a first transport belt that transports the mixture; an accumulation unit that accumulates the mixture on the first transport belt to form a web; a second transport belt that comes into contact with one surface of the web to transport the web; a pressure roller that pressurizes the web; a cleaning unit that removes and recovers residual fibers adhering to the first transport belt; and a fiber transport pipe that transports the residual fibers recovered by the cleaning unit to the defibrator.

A sheet manufacturing apparatus according to an aspect of the present disclosure is a sheet manufacturing apparatus that manufactures a sheet from a material containing fibers. The apparatus includes: a storage tank that stores the material containing the fibers; a defibrator that defibrates the material supplied from the storage tank and discharges the fibers; a mixing unit that mixes the fibers and a binder binding the fibers to each other and discharges a mixture; a first transport belt that transports the mixture; an accumulation unit that accumulates the mixture on the first transport belt to form a web; a second transport belt that comes into contact with one surface of the web to transport the web; a pressure roller that pressurizes the web; a cleaning unit that removes and recovers residual fibers adhering to the second transport belt; and a fiber transport pipe that transports the residual fibers recovered by the cleaning unit to the defibrator.

DESCRIPTION OF EMBODIMENTS

In the following embodiment, as an example of a sheet manufacturing apparatus 1 that manufactures a sheet from a material containing fibers, a sheet manufacturing apparatus 1 that recycles paper pieces such as used paper by using a dry method will be provided and described with reference to the drawings. The sheet manufacturing apparatus 1 of the present disclosure is not limited to being of a dry type and may be of a wet type. In the present embodiment, the dry method refers to being performed not in a liquid but in air such as the atmosphere.

In each of the following drawings, X-, Y-, and Z-axes are given as coordinate axes orthogonal to each other, a direction indicated by each arrow is referred to as a +direction, and a direction opposite to the +direction is referred to as a −direction. The Z-axis is an imaginary axis along a vertical direction, a +Z direction refers to the upward direction, and a −Z direction refers to the downward direction. The −Z direction is a direction in which gravity acts. In addition, in the sheet manufacturing apparatus 1, a leading side in a transport direction of a raw material, a web, a sheet, and the like may be referred to as the downstream, and a trailing side in the transport direction thereof may be referred to as the upstream. For convenience of illustration, the size of each member is different from the actual size thereof.

First, a configuration of the sheet manufacturing apparatus 1 will be described with reference to FIG. 1.

Figure 1:
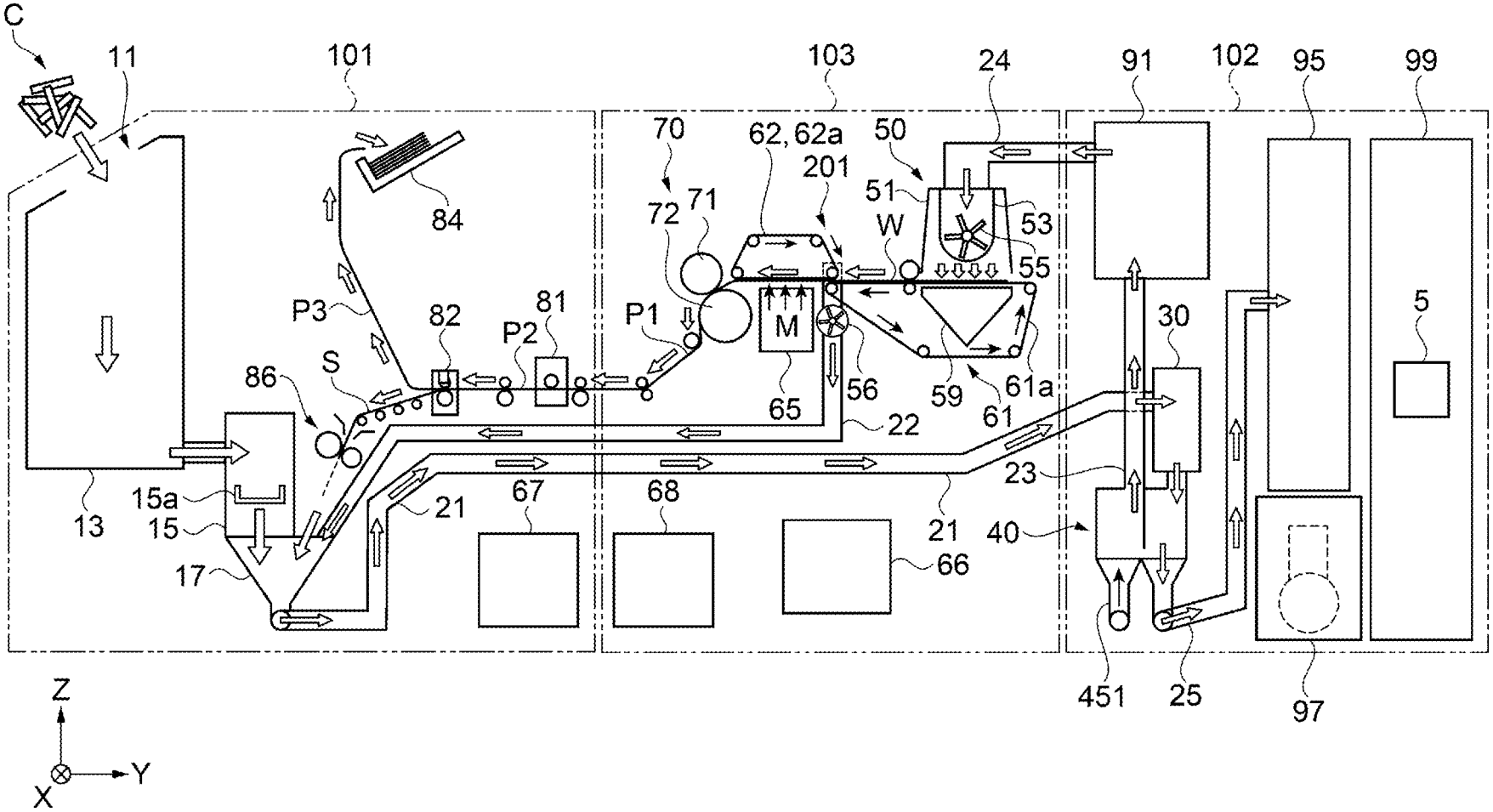
FIG. 1 is a schematic view illustrating a configuration of a sheet manufacturing apparatus.

As illustrated in FIG. 1, the sheet manufacturing apparatus 1 of the present embodiment includes a first unit group 101, a second unit group 102, and a third unit group 103. The first unit group 101, the second unit group 102, and the third unit group 103 are supported by a frame (not illustrated). In FIG. 1, directions in which used paper C, sheets P3, slit pieces S, unnecessary trimmings, and the like move are indicated by white arrows.

The sheet manufacturing apparatus 1 manufactures the sheets P3 from the used paper C that is a material containing fibers. In the sheet manufacturing apparatus 1, in a side view from a −X direction, the first unit group 101, the third unit group 103, and the second unit group 102 are disposed from a −Y direction to a +Y direction.

The used paper C is transported from the first unit group 101 to the second unit group 102 via a pipe 21 that extends across the third unit group 103. Then, the used paper C is subjected to defibration or the like in the second unit group 102 to turn into fibers, and then the fibers are made into a mixture containing a binding material or the like as a binder. The mixture is transported to the third unit group 103 via a pipe 24. The mixture is made into a web W in the third unit group 103, and then is formed into a strip-shaped sheet P1. The strip-shaped sheet P1 is cut into the sheets P3 in the first unit group 101.

The first unit group 101 includes a buffer tank 13 serving as a storage tank; a constant amount supply unit 15; a merging unit 17 serving as a supply duct; and the pipe 21. The merging unit 17 is also referred to as a paper piece merging conduit. In the first unit group 101, these configurations are disposed in the above-described order from upstream toward downstream. In addition, the first unit group 101 also includes a first cutting unit 81, a second cutting unit 82, a tray 84, and a shredding unit 86. The first cutting unit 81 and the second cutting unit 82 cut the strip-shaped sheet P1 into the sheets P3 having a predetermined shape. Further, the first unit group 101 includes a water supply unit 67. The water supply unit 67 is a water storage tank. The water supply unit 67 supplies, through water supply pipes (not illustrated), water for humidification to each of a first humidifying unit 65 and a second humidifying unit 66 to be described later.

The used paper C is charged into the buffer tank 13 from a raw material charging port 11. The used paper C contains fibers such as cellulose and is, for example, paper pieces of shredded used paper. Humidified air is supplied to the inside of the buffer tank 13 from the second humidifying unit 66 provided in the third unit group 103.

The used paper C to be defibrated is temporarily stored in the buffer tank 13 and is then transported to the constant amount supply unit 15 upon the operation of the sheet manufacturing apparatus 1. The sheet manufacturing apparatus 1 may include, upstream of the buffer tank 13, a shredder, which shreds the used paper C or the like.

The constant amount supply unit 15 includes a weighing device 15*a* and a supply mechanism (not illustrated). The weighing device 15*a* weighs a mass of the used paper C. The supply mechanism supplies the used paper C weighed by the weighing device 15*a* to the merging unit 17 located downstream. That is, the constant amount supply unit 15 weighs the used paper C by each predetermined mass by using the weighing device 15*a* and supplies the used paper C to the merging unit 17 located downstream by using the supply mechanism.

Both digital and analog weighing mechanisms can be applied to the weighing device 15*a*. Specifically, examples of the weighing device 15*a* include a physical sensor such as a load cell, a spring balance, a balance, and the like. In the present embodiment, a load cell is used as the weighing device 15*a*. The predetermined mass by which the weighing device 15*a* weighs the used paper C is, for example, approximately several g to several 10 g.

A known technique such as a vibratory feeder can be applied to the supply mechanism. The supply mechanism may be included in the weighing device 15*a*.

The weighing and supplying of the used paper C in the constant amount supply unit 15 is a batch process. That is, the supply of the used paper C from the constant amount supply unit 15 to the merging unit 17 is intermittently performed. The constant amount supply unit 15 may include a plurality of weighing devices 15*a* and may improve the efficiency of weighing by operating the plurality of weighing devices 15*a* with a difference in time.

In the merging unit 17, the shredded pieces of the slit pieces S supplied from the shredding unit 86 are merged and mixed with the used paper C supplied from the constant amount supply unit 15. The slit pieces S and the shredding unit 86 will be described later. The used paper C with which the shredded pieces are mixed flows into the pipe 21 from the merging unit 17.

The pipe 21 transports the used paper C from the first unit group 101 to the second unit group 102 using an airflow generated by a blower (not illustrated).

The second unit group 102 includes a defibrator 30 that is a dry defibrator, a separator 40, a pipe 23, a mixing unit 91, and the pipe 24. In the second unit group 102, these configurations are disposed in the above-described order from upstream toward downstream. In addition, the second unit group 102 also includes a recovery unit 95, a compressor 97, a power supply unit 99, a pipe 25 connected to the separator 40, and an airflow pipe 451.

The used paper C transported through the pipe 21 flows into the defibrator 30. The defibrator 30 defibrates the used paper C, which is supplied from the constant amount supply unit 15, into fibers using a dry method. A known defibrating mechanism can be applied to the defibrator 30. Tangled fibers contained in the paper pieces are defibrated by the defibrator 30 to turn the used paper C into a defibrated material containing fibers, and the defibrated material is transported to the separator 40.

The separator 40 separates the defibrated fibers. In detail, the separator 40 removes components that are contained in the fibers and are unnecessary for manufacturing the sheets P3. That is, the separator 40 separates the fibers into relatively long fibers and relatively short fibers. Since the relatively short fibers may cause a decrease in the strength of the sheets P3, the relatively short fibers are sorted and removed by the separator 40. In addition, the separator 40 also removes a coloring material, an additive, or the like contained in the used paper C. The separator 40 is of a disk type.

Humidified air is supplied to the inside of the separator 40 from the second humidifying unit 66 of the third unit group 103.

The relatively short fibers and the like are removed from the defibrated fibers, and the defibrated fibers are transported to the mixing unit 91 via the pipe 23 by an airflow generated by a blower (not illustrated) disposed at a tip of the airflow pipe 451. Unnecessary components such as relatively short fibers and a coloring material are discharged from the pipe 25 to the recovery unit 95.

The mixing unit 91 mixes the fibers with a binding material or the like in air to form a mixture. Although not illustrated, the mixing unit 91 includes a flow path through which the fibers are transported, a fan, a hopper, a supply pipe, and a valve.

The hopper communicates with the flow path of the fibers via the supply pipe. The valve is provided in the supply pipe between the hopper and the flow path. The hopper supplies a binding material such as starch into the flow path. The valve adjusts the mass of the binding material supplied from the hopper to the flow path. Accordingly, the mixing ratio of the fibers and the binding material is adjusted.

The mixing unit 91 may include a similar configuration for supplying a coloring material, an additive, or the like, in addition to the above-described configurations for supplying the binding material.

The fan of the mixing unit 91 mixes the binding material and the like with the fibers in air to form a mixture while transporting the fibers downstream by using a generated airflow. The mixture flows into the pipe 24 from the mixing unit 91.

The recovery unit 95 includes a filter (not illustrated). The filter filters out unnecessary components such as relatively short fibers transported through the pipe 25 by the airflow.

The compressor 97 generates compressed air. The filter may be clogged with fine particles or the like among the unnecessary components. The filter can be cleaned by blowing the compressed air generated by the compressor 97 onto the filter to blow off adhering particles.

The power supply unit 99 includes a power supply device (not illustrated) that supplies electric power to a control unit 5 and the sheet manufacturing apparatus 1. The power supply unit 99 distributes electric power supplied from the outside to each configuration of the sheet manufacturing apparatus 1. The control unit 5 is electrically connected to each configuration of the sheet manufacturing apparatus 1 and comprehensively controls the operation of these configurations.

The third unit group 103 accumulates and compresses the mixture containing the fibers to form the strip-shaped sheet P1 that is recycled paper. The third unit group 103 includes an accumulation unit 50, a first transport unit 61, a second transport unit 62, the first humidifying unit 65, the second humidifying unit 66, a drainage unit 68, and a forming unit 70 that is a sheet forming unit.

In the third unit group 103, the accumulation unit 50, the first transport unit 61, the second transport unit 62, the first humidifying unit 65, and the forming unit 70 are disposed in the above-described order from upstream toward downstream. The second humidifying unit 66 is disposed below the first humidifying unit 65.

The accumulation unit 50 accumulates the mixture containing the fibers, which is supplied from the separator 40, by using an airflow and gravity to form the web W. The accumulation unit 50 includes a drum member 53, a blade member 55 installed inside the drum member 53, a housing 51 that accommodates the drum member 53, and a suction unit 59. The mixture is taken to the inside of the drum member 53 from the pipe 24.

The first transport unit 61 is disposed below the accumulation unit 50. The first transport unit 61 includes a first transport belt 61*a* and tension rollers 31 that tension the first transport belt 61*a*. The suction unit 59 faces the drum member 53 with the first transport belt 61*a* interposed therebetween in a direction along the Z-axis.

The blade member 55 is disposed inside the drum member 53 and is rotationally driven by a motor (not illustrated). The drum member 53 is a semi-cylindrical sieve. A net having the function of a sieve is provided on a side surface of the drum member 53, the side surface facing downward. The drum member 53 allows particles such as the fibers or mixture smaller than the size of the mesh opening of the sieve to pass therethrough from the inside to the outside.

The mixture is discharged to the outside of the drum member 53 while being stirred by the rotating blade member 55 inside the drum member 53. Humidified air is supplied to the inside of the drum member 53 from the second humidifying unit 66.

The suction unit 59 is disposed below the drum member 53. The suction unit 59 suctions air inside the housing 51 via a plurality of holes that the first transport belt 61*a* includes. Accordingly, an airflow that accumulates the mixture on the first transport belt 61*a* is generated. The plurality of holes of the first transport belt 61*a* allow the air to pass therethrough, and make it difficult for the fibers, the binding material, and the like contained in the mixture to pass therethrough. Accordingly, the mixture discharged to the outside of the drum member 53 is suctioned downward together with the air. The suction unit 59 is a known suction device such as a blower.

The mixture is dispersed in the air inside the housing 51 and is accumulated on an upper surface of the first transport belt 61*a* by gravity and an airflow, which is generated by the suction unit 59, to become the web W.

Figure 2:
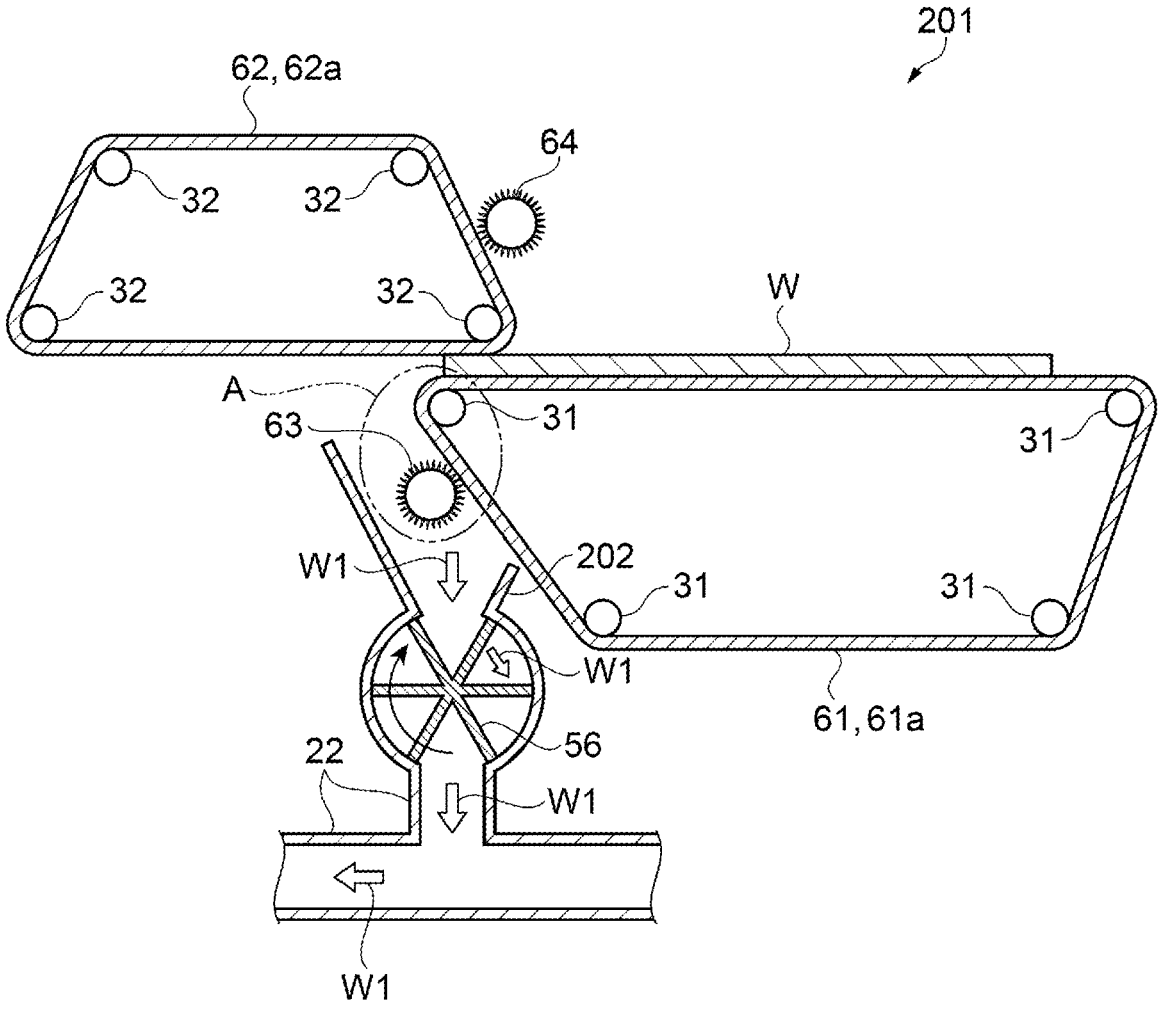
FIG. 2 is a sectional view illustrating a configuration of a cleaning unit.

The first transport belt 61*a* is an endless belt and is tensioned by the tension rollers 31 (refer to FIG. 2). The first transport belt 61*a* is rotated counterclockwise in FIG. 1 by the rotation of the tension rollers 31. Accordingly, the mixture is continuously accumulated on the first transport belt 61*a*, and the web W is formed. The web W contains a relatively large amount of air and is soft and swollen. The first transport unit 61 transports the formed web W downstream upon the rotation of the first transport belt 61*a*.

The second transport unit 62 transports, after the first transport unit 61, the web W at a location downstream of the first transport unit 61. The second transport unit 62 peels the web W from the upper surface of the first transport belt 61*a* and transports the web W toward the forming unit 70. The second transport unit 62 is disposed above a transport path of the web W and slightly upstream of a starting point on a return side of the first transport belt 61*a*. The +Y direction of the second transport unit 62 and the −Y direction of the first transport belt 61*a* partially overlap each other in the vertical direction.

The second transport unit 62 includes a second transport belt 62*a*, a plurality of rollers 32 (refer to FIG. 2), and a suction mechanism. The second transport belt 62*a* is provided with a plurality of holes through which air passes. The second transport belt 62*a* is tensioned by the plurality of rollers 32 and is rotated by the rotation of the rollers 32.

The second transport unit 62 causes an upper surface of the web W, which is one surface, to be suctioned to a lower surface of the second transport belt 62*a* using a negative pressure generated by the suction mechanism. In this state, as the second transport belt 62*a* rotates, the web W is suctioned to the second transport belt 62*a* and is transported downstream.

Brush rollers 63 and 64 (refer to FIG. 2) for removing residual fibers W1 adhering to the transport belts 61*a* and 62*a* are disposed in the first transport unit 61 and the second transport unit 62. A cleaning unit 201 including the brush rollers 63 and 64 is provided in a region extending from a portion where the first transport unit 61 and the second transport unit 62 overlap each other to below the first transport unit 61 and the second transport unit 62.

A fiber transport pipe 22 that transports the residual fibers W1 recovered by the cleaning unit 201 to the defibrator 30 is connected to the cleaning unit 201. Specifically, the cleaning unit 201 is connected to the defibrator 30 via the fiber transport pipe 22, the merging unit 17, and the pipe 21.

The merging unit 17 is connected to the buffer tank 13, the fiber transport pipe 22, and the defibrator 30. That is, the residual fibers W1 recovered by the cleaning unit 201 flow into the defibrator 30 through the fiber transport pipe 22, the merging unit 17, and the pipe 21.

As described above, since the residual fibers W1 recovered by the cleaning unit 201 are transported to the defibrator 30 via the fiber transport pipe 22, the need for a user to remove the residual fibers W1 adhering to the transport belts 61*a* and 62*a* of the first transport unit 61 and the second transport unit 62, namely, to perform maintenance can be suppressed. Further, the amount of the residual fibers W1 to be discarded as waste can be reduced, and waste of the raw material can be suppressed.

The first humidifying unit 65 humidifies the web W containing fibers accumulated in the accumulation unit 50 of the third unit group 103. In detail, the first humidifying unit 65 is, for example, a mist humidifier and supplies mist M from below to the web W, which is transported by the second transport unit 62, to humidify the web W. The first humidifying unit 65 is disposed below the second transport unit 62 and faces the web W, which is transported by the second transport unit 62, in the direction along the Z-axis. For example, a known humidifying device such as an ultrasonic humidifying device can be used as the first humidifying unit 65.

By humidifying the web W with the mist M, the function of the starch as a binding material is promoted, and the strength of the sheets P3 is improved. In addition, since the web W is humidified from below, droplets derived from mist are prevented from falling onto the web W. Further, since humidification is performed from a side opposite from a contact surface of the web W with the second transport belt 62*a*, sticking of the web W to the second transport belt 62*a* is reduced. The second transport unit 62 transports the web W to the forming unit 70.

The forming unit 70 includes processing rollers 71 and 72. The processing rollers 71 and 72 compress the web W containing fibers to form the strip-shaped sheet P1. The processing rollers 71 and 72 form a pair, each of which includes an electric heater built therein and has the function of increasing the temperature of a roller surface.

Each of the processing rollers 71 and 72 is a substantially columnar member. A rotating shaft of the processing roller 71 and a rotating shaft of the processing roller 72 are disposed along the X-axis. The processing roller 71 is disposed substantially above the transport path of the web W, and the processing roller 72 is disposed substantially below the transport path of the web W.

The processing roller 72 is rotationally driven by a stepping motor (not illustrated). The processing roller 71 is a driven roller that is not driven by a motor but rotates in conjunction with the rotation of the processing roller 72. For that reason, the processing roller 71 rotates in an opposite direction to the processing roller 72 in side view from the −X direction.

The web W is sent downstream while being heated and pressurized with the web W pinched between the processing roller 71 and the processing roller 72 serving as pressure rollers. That is, the web W continuously passes through the forming unit 70 and is press-formed while being heated. By using the processing rollers 71 and 72 as a pair of forming members, the web W can be efficiently heated and pressurized.

As the web W passes through the forming unit 70, the amount of air contained in the web W is reduced from a state where the web W contains a relatively large amount of air and is soft, and the fibers are bound to each other by the binding material, thereby forming the strip-shaped sheet P1. The strip-shaped sheet P1 is transported to the first unit group 101 by a transport roller (not illustrated).

The second humidifying unit 66 is disposed below the first humidifying unit 65. A known evaporative humidifying device can be applied as the second humidifying unit 66. Examples of the evaporative humidifying device include a humidifying device that generates humidified air by blowing air onto a wet non-woven fabric or the like to vaporize moisture.

The second humidifying unit 66 humidifies a predetermined region of the sheet manufacturing apparatus 1. The predetermined region is one or more of the buffer tank 13, the separator 40, and the inside of the drum member 53 of the accumulation unit 50. Specifically, the humidified air is supplied from the second humidifying unit 66 to the above-described region via a plurality of pipes (not illustrated). The humidified air suppresses electrostatic charging of the used paper C, fibers, or the like in each of the above-described configurations and suppresses adhesion thereof to members due to static electricity.

The drainage unit 68 is a drainage tank. The drainage unit 68 collects and stores used moisture that is used in the first humidifying unit 65, the second humidifying unit 66, and the like. The drainage unit 68 is detachable from the sheet manufacturing apparatus 1 as necessary to discard the accumulated water.

The strip-shaped sheet P1 transported to the first unit group 101 reaches the first cutting unit 81. The first cutting unit 81 cuts the strip-shaped sheet P1 in a direction intersecting the transport direction, for example, in a direction along the X-axis. The strip-shaped sheet P1 is cut into single-cut sheets P2 by the first cutting unit 81. The single-cut sheets P2 are transported from the first cutting unit 81 to the second cutting unit 82.

The second cutting unit 82 cuts each single-cut sheet P2 in the transport direction, for example, in a direction along the Y-axis. In detail, the second cutting unit 82 cuts vicinities of edges on both sides of each single-cut sheet P2 in the direction along the X-axis. Accordingly, each single-cut sheet P2 becomes the sheet P3 having a predetermined shape such as an A4 size or an A3 size.

When each single-cut sheet P2 is cut into the sheet P3 in the second cutting unit 82, the slit pieces S that are trimmings are generated. The slit pieces S are transported substantially in the −Y direction and reach the shredding unit 86 that is a shredder. The shredding unit 86 shreds the slit pieces S into shredded pieces, and the shredded pieces are supplied to the merging unit 17. A mechanism for weighing and supplying the shredded pieces of the slit pieces S to the merging unit 17 may be installed between the shredding unit 86 and the merging unit 17.

The sheets P3 are transported substantially upward and are stacked in the tray 84. As described above, the sheets P3 are manufactured by the sheet manufacturing apparatus 1. The sheet P3 can be used, for example, as a substitute for copy paper or the like.

Next, a configuration of the cleaning unit 201 will be described with reference to FIGS. 2 to 4.

As illustrated in FIG. 2, the cleaning unit 201 includes the brush roller 63 disposed in the first transport unit 61; the brush roller 64 disposed in the second transport unit 62; a recovery box 202; a rotary valve 56; and the fiber transport pipe 22.

The brush rollers 63 and 64 are made of, for example, a napped material. The brush roller 63 is disposed to be able to come into contact with the first transport belt 61*a* of the first transport unit 61. The brush roller 64 is disposed to be able to come into contact with the second transport belt 62*a* of the second transport unit 62.

Figure 3:
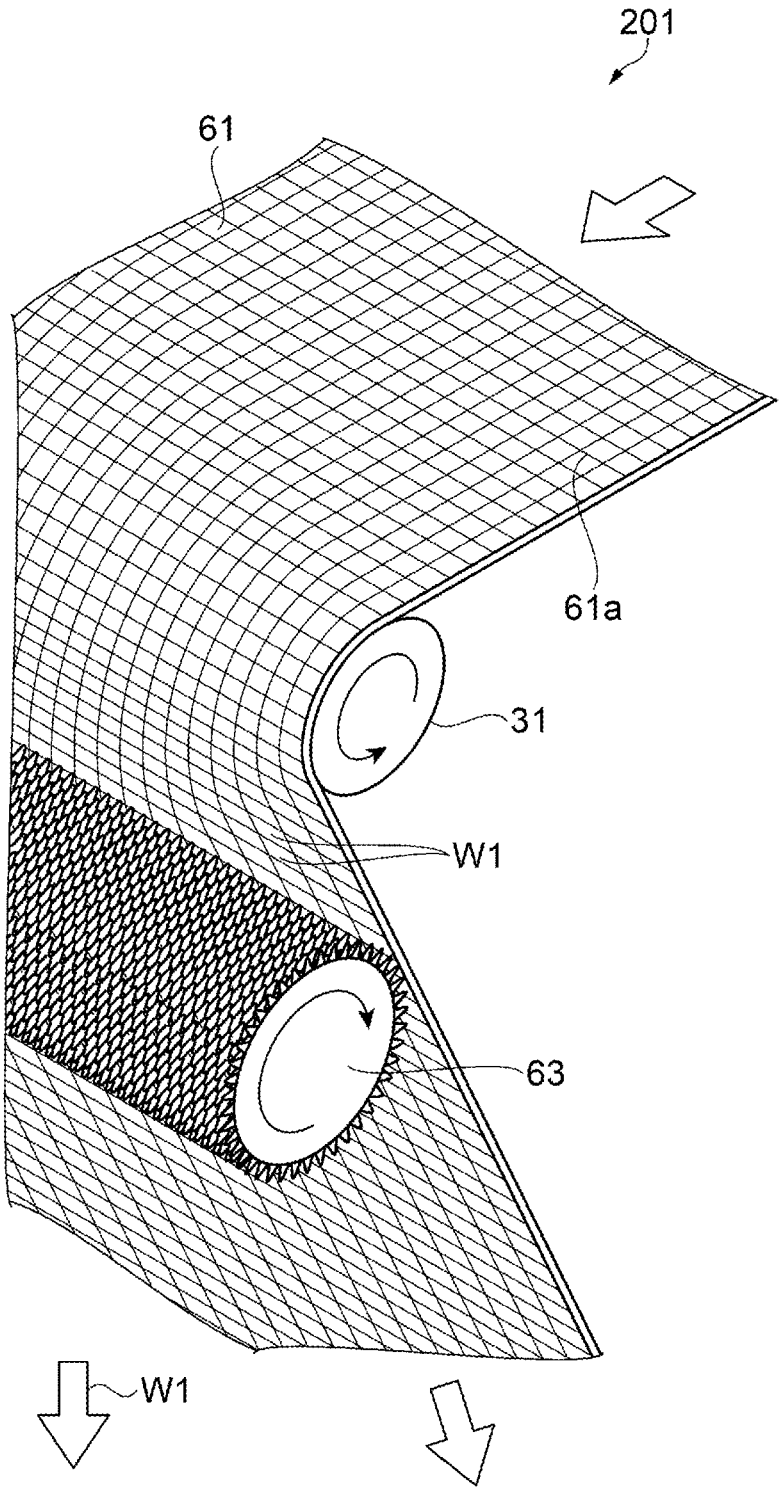
FIG. 3 is an enlarged perspective view of a portion A of the cleaning unit illustrated in FIG. 2.

As illustrated in FIG. 3, the brush rollers 63 and 64 rotate and come into contact with the transport belts 61*a* and 62*a*, so that the residual fibers W1 adhering to the transport belts 61*a* and 62*a* can be removed, specifically, the residual fibers W1 can be made to fall downward.

Figure 4:
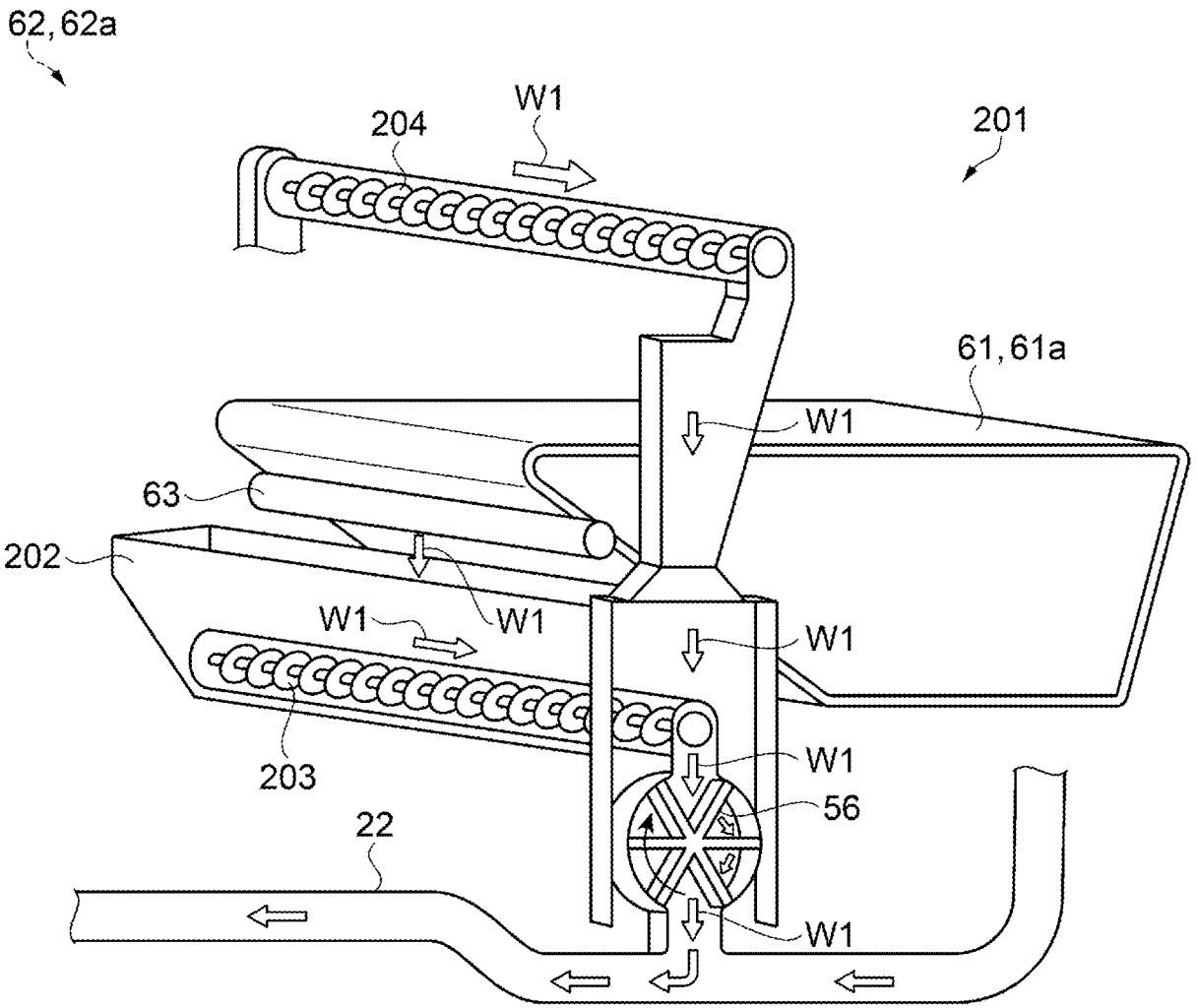
FIG. 4 is a perspective view illustrating a construction of a rotary valve.

As illustrated in FIGS. 2 and 4, the recovery box 202 recovers the residual fibers W1 that are made to fall by the rotating brush rollers 63 and 64. Specifically, as illustrated in FIG. 4, the residual fibers W1 removed from the first transport belt 61*a* are transported, by a recovery screw 203, to a front side of the recovery box 202, namely, to a rotary valve 56 side. The residual fibers W1 removed from the second transport belt 62*a* are transported, by a recovery screw 204, to the front side of the recovery box 202, namely, to the rotary valve 56 side.

The rotary valve 56 is disposed between the cleaning unit 201 and the fiber transport pipe 22. The rotary valve 56 includes, for example, a rotating body including five blades, and opening portions are provided at an upper portion and a lower portion thereof. The rotating body is partitioned for each space between the blades. The rotary valve 56 has a structure in which the residual fibers W1 falling from above and the residual fibers W1 accumulated on partitioned portions are moved downward by the rotation of the blades and are discharged by gravity.

Since the rotary valve 56 is disposed, when the residual fibers W1 are sent from the cleaning unit 201 to the fiber transport pipe 22, the residual fibers W1 can be sent while maintaining airtightness, and the back flow of the residual fibers W1 to the cleaning unit 201 can be suppressed.

As described above, the sheet manufacturing apparatus 1 of the present embodiment is the sheet manufacturing apparatus 1 that manufactures the sheet P3 from a material containing fibers. The apparatus includes: the buffer tank 13 that stores the material containing the fibers; the defibrator 30 that defibrates the material supplied from the buffer tank 13 and discharges the fibers; the mixing unit 91 that mixes the fibers and a binding material serving as a binder binding the fibers to each other and discharges a mixture; the first transport belt 61*a* that transports the mixture; the accumulation unit 50 that accumulates the mixture on the first transport belt 61*a* to form the web W; the second transport belt 62*a* that comes into contact with one surface of the web W to transport the web W; the processing rollers 71 and 72 that pressurize the web W; the cleaning unit 201 that removes and recovers the residual fibers W1 adhering to the first transport belt 61*a*; and the fiber transport pipe 22 that transports the residual fibers W1 recovered by the cleaning unit 201 to the defibrator 30.

According to this configuration, since the residual fibers W1 recovered by the cleaning unit 201 are transported to the defibrator 30 via the fiber transport pipe 22, the need for a user to remove the residual fibers W1 adhering to the first transport belt 61*a*, namely, to perform maintenance can be suppressed. Further, the amount of the residual fibers W1 to be discarded as waste can be reduced, and waste of the raw material can be suppressed.

In addition, in the sheet manufacturing apparatus 1 of the present embodiment, it is preferable to include the merging unit 17 connected to the buffer tank 13, the fiber transport pipe 22, and the defibrator 30. According to this configuration, since the merging unit 17 is provided, the raw material from the buffer tank 13 and the residual fibers W1 from the fiber transport pipe 22 can be supplied to the defibrator 30.

In addition, in the sheet manufacturing apparatus 1 of the present embodiment, it is preferable that the rotary valve 56 is disposed between the cleaning unit 201 and the fiber transport pipe 22. According to this configuration, since the rotary valve 56 is disposed, when the residual fibers W1 are sent from the cleaning unit 201 to the fiber transport pipe 22, the residual fibers W1 can be sent while maintaining airtightness, and the back flow of the residual fibers W1 to the cleaning unit 201 can be suppressed.

In addition, the sheet manufacturing apparatus 1 of the present embodiment is the sheet manufacturing apparatus 1 that manufactures the sheet P3 from a material containing fibers. The apparatus includes: the buffer tank 13 that stores the material containing the fibers; the defibrator 30 that defibrates the material supplied from the buffer tank 13 and discharges the fibers; the mixing unit 91 that mixes the fibers and a binding material serving as a binder binding the fibers to each other and discharges a mixture; the first transport belt 61*a* that transports the mixture; the accumulation unit 50 that accumulates the mixture on the first transport belt 61*a* to form the web W; the second transport belt 62*a* that comes into contact with one surface of the web W to transport the web W; the processing rollers 71 and 72 that pressurize the web W; the cleaning unit 201 that removes and recovers the residual fibers W1 adhering to the second transport belt 62*a*; and the fiber transport pipe 22 that transports the residual fibers W1 recovered by the cleaning unit 201 to the defibrator 30.

According to this configuration, since the residual fibers W1 recovered by the cleaning unit 201 are transported to the defibrator 30 via the fiber transport pipe 22, the need for a user to remove the residual fibers W1 adhering to the second transport belt 62*a*, namely, to perform maintenance can be suppressed. Further, the amount of the residual fibers W1 to be discarded as waste can be reduced, and waste of the raw material can be suppressed.

In addition, in the sheet manufacturing apparatus 1 of the present embodiment, it is preferable to include the merging unit 17 connected to the buffer tank 13, the fiber transport pipe 22, and the defibrator 30. According to this configuration, since the merging unit 17 is provided, the raw material from the buffer tank 13 and the residual fibers W1 from the fiber transport pipe 22 can be supplied to the defibrator 30.

Hereinafter, modification examples of the above-described embodiment will be described.

As described above, the present disclosure is not limited to the configuration in which the brush rollers 63 and 64 are disposed in the first transport unit 61 and the second transport unit 62, respectively, and only the brush roller 63 may be disposed in the first transport unit 61, or only the brush roller 64 may be disposed in the second transport unit 62.

What is claimed is:

1. A sheet manufacturing apparatus that manufactures a sheet from a material containing fibers, the apparatus comprising:

a storage tank that stores the material containing the fibers;

a defibrator that defibrates the material supplied from the storage tank and discharges the fibers;

a mixing unit that mixes the fibers and a binder binding the fibers to each other and discharges a mixture;

a first transport belt that transports the mixture;

an accumulation unit that accumulates the mixture on the first transport belt to form a web;

a second transport belt that comes into contact with one surface of the web to transport the web;

a pressure roller that pressurizes the web;

a cleaning unit that removes and recovers residual fibers adhering to the first transport belt; and a fiber transport pipe that transports the residual fibers recovered by the cleaning unit to the defibrator.

2. The sheet manufacturing apparatus according to claim 1, further comprising a supply duct connected to the storage tank, the fiber transport pipe, and the defibrator.

3. The sheet manufacturing apparatus according to claim 1, further comprising a rotary valve disposed between the cleaning unit and the fiber transport pipe.

4. A sheet manufacturing apparatus that manufactures a sheet from a material containing fibers, the apparatus comprising:

a storage tank that stores the material containing the fibers;

a defibrator that defibrates the material supplied from the storage tank and discharges the fibers;

a mixing unit that mixes the fibers and a binder binding the fibers to each other and discharges a mixture;

a first transport belt that transports the mixture;

an accumulation unit that accumulates the mixture on the first transport belt to form a web;

a second transport belt that comes into contact with one surface of the web to transport the web;

a pressure roller that pressurizes the web;

a cleaning unit that removes and recovers residual fibers adhering to the second transport belt; and a fiber transport pipe that transports the residual fibers recovered by the cleaning unit to the defibrator.

5. The sheet manufacturing apparatus according to claim 4, further comprising;

a supply duct connected to the storage tank, the fiber transport pipe, and the defibrator.

* * * * *